US009981817B2

(12) United States Patent
Sone

(10) Patent No.: US 9,981,817 B2
(45) Date of Patent: May 29, 2018

(54) IMAGE FORMING APPARATUS THAT CHANGES OVER PAPER FEEDING STAGES

(71) Applicant: KYOCERA Document Solutions Inc., Osaka (JP)

(72) Inventor: Daiki Sone, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/283,171

(22) Filed: Sep. 30, 2016

(65) Prior Publication Data

US 2017/0088378 A1 Mar. 30, 2017

(30) Foreign Application Priority Data

Sep. 30, 2015 (JP) ..... 2015-193603

(51) Int. Cl.
*B65H 3/44* (2006.01)
*B65H 7/04* (2006.01)
(Continued)

(52) U.S. Cl.
CPC ..... *B65H 7/04* (2013.01); *B65H 1/266* (2013.01); *B65H 3/44* (2013.01); *G03G 15/6508* (2013.01); *B65H 7/20* (2013.01); *B65H 43/02* (2013.01); *B65H 2511/20* (2013.01); *B65H 2511/30* (2013.01); *B65H 2511/414* (2013.01); *B65H 2511/415* (2013.01); *B65H 2513/42* (2013.01); *B65H 2801/06* (2013.01); *G03G 15/50* (2013.01); *G03G 2215/00729* (2013.01)

(58) Field of Classification Search
CPC ..... B65H 7/04; B65H 3/44; B65H 43/02
See application file for complete search history.

(56) References Cited

U.S. PATENT DOCUMENTS 7,177,554 B2 * 2/2007 Van Vliembergen .... B65H 3/44 271/9.01
8,342,501 B2 * 1/2013 Yoshimura ..... B65H 3/44 271/34
2009/0261524 A1 * 10/2009 Nakayama ..... B65H 3/44 271/3.14

FOREIGN PATENT DOCUMENTS

JP 61023049 A * 1/1986
JP 04080143 A * 3/1992
(Continued)

*Primary Examiner* — Howard J Sanders
(74) *Attorney, Agent, or Firm* — Hawaii Patent Services; Nathaniel K. Fedde; Kenton N. Fedde

(57) ABSTRACT

Provided is an image forming apparatus preventing lowering of continuous printing performance; including plural paper feeding stages in main body; a residual paper quantity detection sensor; a printer part printing on paper; a paper feeding stage searching part functioning every time paper feeding is made; a paper feeding stage selection part determining existence of paper feeding capable stage, on result by paper feeding stage searching part, and selecting a paper feeding stage; a system control part performing stage changeover according to selection result by paper feeding stage selection part; when there exists no paper feeding capable stage, paper feeding stage selection part notifying system control part of it, and when there exists paper feeding capable stage, paper feeding stage selection part altering priority levels in stage searching on detection result by residual paper quantity detection sensor, and number of sheets required for printing, selecting paper feeding stage.

4 Claims, 5 Drawing Sheets

(51) Int. Cl.

| | |
|---|---|
| ***B65H 1/26*** | (2006.01) |
| ***G03G 15/00*** | (2006.01) |
| *B65H 43/02* | (2006.01) |
| *B65H 7/20* | (2006.01) |

(56) References Cited

FOREIGN PATENT DOCUMENTS

| | | | | |
|---|---|---|---|---|
| JP | H08-282033 | A | | 10/1996 |
| JP | H11-157684 | A | | 6/1999 |
| JP | 2004-322613 | A | | 11/2004 |
| JP | 2006-206287 | A | | 8/2006 |
| JP | 2010-134158 | A | | 6/2010 |
| JP | 2016216196 | A | * | 12/2016 |

* cited by examiner

FIG.3A

TYPICAL PAPER FEEDING STAGE SELECTION

| | PAPER FEEDING CASSETTE | PAPER SHEET FEEDING CAPABLE OR NOT CAPABLE | RESIDUAL PAPER SHEET QUANTITY |
|---|---|---|---|
| 301 | PAPER FEEDING CASSETTE | PAPER SHEET FEEDING CAPABLE | 100% |
| 302 | PAPER FEEDING CASSETTE | PAPER SHEET FEEDING NOT CAPABLE | 100% |
| 303 | PAPER FEEDING CASSETTE | PAPER SHEET FEEDING CAPABLE | 10% |
| 304 | PAPER FEEDING CASSETTE | PAPER SHEET FEEDING CAPABLE | 10% |
| 305 | PAPER FEEDING CASSETTE | PAPER SHEET FEEDING CAPABLE | 10% |

DEFAULT

FIG.3B

PAPER FEEDING STAGE SELECTION IN PRESENT EMBODIMENT

| | PAPER FEEDING CASSETTE | PAPER SHEET FEEDING CAPABLE OR NOT CAPABLE | RESIDUAL PAPER SHEET QUANTITY |
|---|---|---|---|
| 301 | PAPER FEEDING CASSETTE | PAPER SHEET FEEDING CAPABLE | 10% |
| 302 | PAPER FEEDING CASSETTE | PAPER SHEET FEEDING CAPABLE | 10% |
| 303 | PAPER FEEDING CASSETTE | PAPER SHEET FEEDING CAPABLE | 30% |
| 304 | PAPER FEEDING CASSETTE | PAPER SHEET FEEDING CAPABLE | 50% |
| 305 | PAPER FEEDING CASSETTE | PAPER SHEET FEEDING CAPABLE | 80% |

DEFAULT

IMAGE FORMING APPARATUS THAT CHANGES OVER PAPER FEEDING STAGES

INCORPORATION BY REFERENCE

This application is based on and claims the benefit of priority from Japanese Patent Application No. 2015-193603 filed on Sep. 30, 2015, the contents of which are hereby incorporated by reference.

BACKGROUND

The present disclosure relates to an image forming apparatus that reads a document to generate image data.

For example, typical image forming apparatuses that are an MFP (Multifunction Peripheral), such as a printer, a multi-function printer, or a multifunction machine, are often provided with a plurality of paper feed cassettes in consideration of convenience of users, and the like. In this way, by providing a plurality of paper feed cassettes, in the event that, during printing, all sheets in a paper feed cassette that is feeding paper are used up, it is made possible to feed paper from another paper feed cassette that stores sheets of, for example, the same type (such as paper quality or size). Thereby, occurrence of an interruption of printing processing can be avoided to allow continuous printing.

As the typical technique for selecting a paper feeding cassette, there is available a technique that, in an image forming apparatus in which an image formed on a photosensitive drum is transferred to a paper sheet through an intermediate transfer belt and there are provided a plurality of trays for storing transfer paper sheets of the same size, when the transfer paper sheets stored in a tray that is set as the tray for paper sheet feeding have been used up, performs changeover to a tray the distance from which to the intermediate transfer belt is short as compared to the distance from the relevant tray to the intermediate transfer belt.

SUMMARY

An image forming apparatus according to an embodiment of the present disclosure is an image forming apparatus, including a plurality of paper feeding stages that are loaded in the inside of an apparatus main body; a residual paper sheet quantity detection sensor that detects a residual quantity of paper sheet that is stored in the paper feeding stage; a printer part that performs printing on the paper sheet; a paper feeding stage searching part that performs a paper feeding stage searching operation every time paper sheet feeding is made from the paper feeding stage; a paper feeding stage selection part that determines whether or not the paper feeding stage that is capable of paper sheet feeding, based on the result of searching for a paper feeding stage by the paper feeding stage searching part, and selects a paper feeding stage; and a system control part that, based on the result of selection by the paper feeding stage selection part, performs changeover of paper feeding stages from the selected paper feeding stage to the printer part; in the case where there exists no paper feeding stage that is capable of paper sheet feeding, the paper feeding stage selection part notifying the system control part of that there exists no paper feeding stage that is capable of paper sheet feeding, and in the case where there exists the paper feeding stage that is capable of paper sheet feeding, the paper feeding stage selection part altering the levels of priority in the paper feeding stage searching operation based on the result of detection by the residual paper sheet quantity detection sensor and the number of paper sheets required for printing, and selecting the paper feeding stage.

BRIEF DESCRIPTION OF THE DRAWINGS

FIG. 3A is a figure for explaining the paper feeding stage selection by a paper feeding stage selection part in FIG. 2, and with FIG. 3A, a typical paper feeding stage selection will be explained for comparison with the paper feeding stage selection by the paper feeding stage selection part in the present embodiment;

FIG. 3B is a figure for explaining the paper feeding stage selection by the paper feeding stage selection part in FIG. 2, and with FIG. 3B, the paper feeding stage selection by the paper feeding stage selection part in the present embodiment will be explained.

DETAILED DESCRIPTION

Hereinbelow, an embodiment of an image forming apparatus of the present disclosure will be explained with reference to FIG. 1 to FIG. 4. As an example of an image forming apparatus in the following explanation, the image forming apparatus is assumed to be an MFP (Multifunction Peripheral), which is a multifunctional peripheral that provides multiple operation functions for such jobs as copying, printing, and facsimiling.

Figure 1:
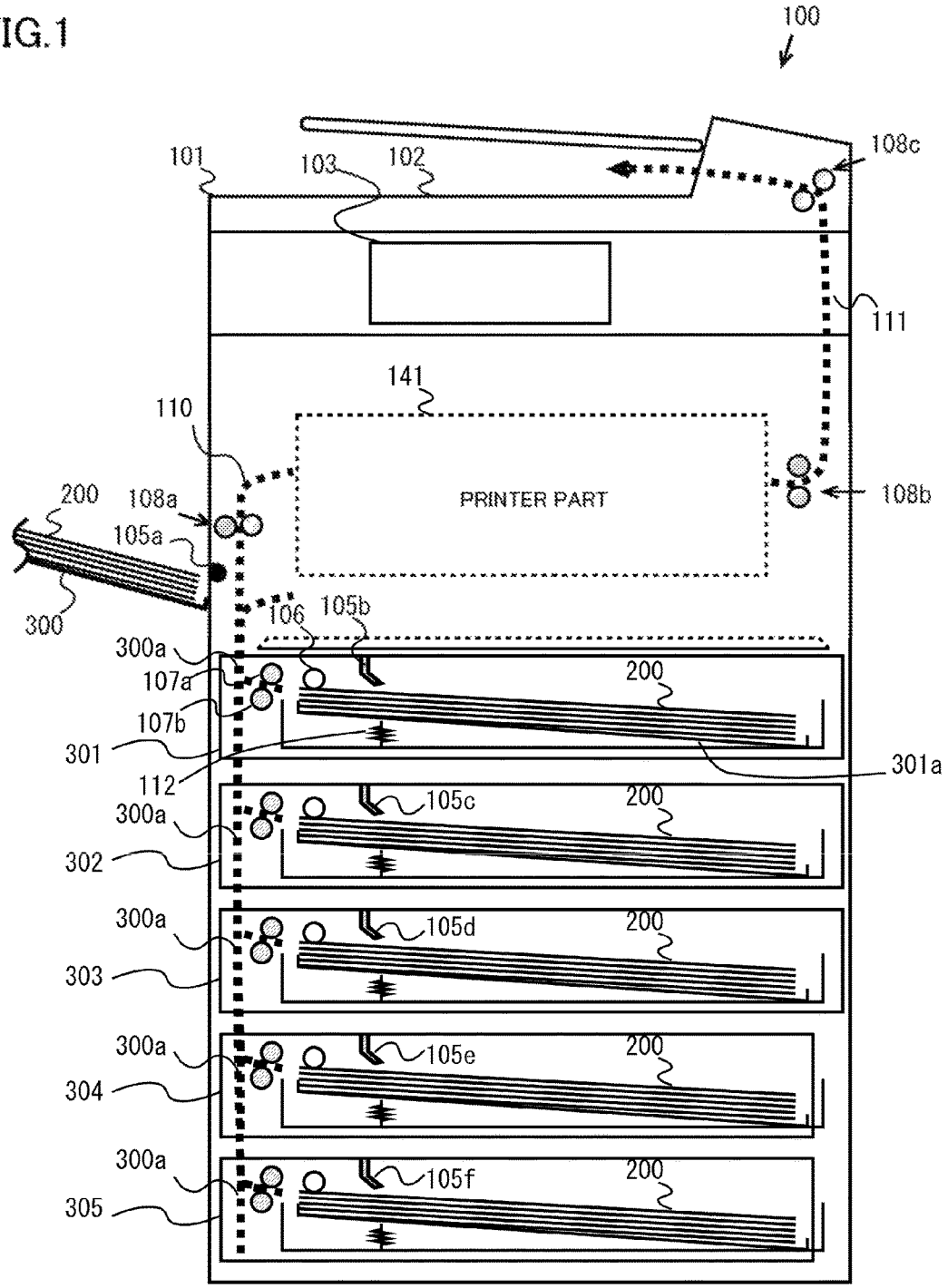
FIG. 1 shows an embodiment in the case where the image forming apparatus in the present disclosure is assumed to be an MFP.

First, as shown in FIG. 1, in an MFP 100, a paper delivery tray 102 and a panel part 103 are provided in the upper part of an MFP main body 101. In addition, on the side part of the MFP main body 101, there is provided an MP (Multipurpose) tray 300 that is a paper feeding stage in which a paper sheet 200 of any type (such as paper quality or size) can be set. The paper sheet 200 that has been set in the MP tray 300 is fed out into a later-described carrying passage 110.

In the inside of the MFP main body 101, there is disposed a printer part 141 having such components as a photosensitive drum. Under the printer part 141, a plurality of paper feeding cassettes 301 to 305, which are paper feeding stages that store a plurality of paper sheets 200, are disposed, being vertically stacked. The number of the paper feeding cassettes 301 to 305 is not limited to 5, as shown in the figure. In other words, the number may be four or smaller, or six or larger.

In addition, these paper feeding cassettes 301 to 305 are freely attachable/detachable to/from the MFP main body 101. In addition, for the respective paper feeding cassettes 301 to 305, there is provided with a common carrying passage 300*a*, which is used for carrying a paper sheet 200 that is fed from a paper feeding cassette located at a lower stage. The common carrying passages 300*a* are linked to a later-described carrying passage 110 with the respective paper feeding cassettes 301 to 305 being stored in the MPF main body 101. By providing the respective paper feeding cassettes 301 to 305 with a common carrying passage 300*a*, it is possible to make the MFP 100 compact, or achieve some other purpose. However, needless to say, the common carrying passage 300*a* may be provided as an ordinary carrying passage on the side of the MPF main body 101 rather than being provided for the respective paper feeding cassettes 301 to 305.

In addition, in the inside of the MFP main body 101, there are disposed residual paper sheet quantity detection sensors 105*a* to 105*f*, a feeding roller 106, a driving roller 107*a*, and a driven roller 107*b*. The respective residual paper sheet quantity detection sensors 105*b* to 105*f*, the feeding roller 106, the driving roller 107*a*, and the driven roller 107*b* are disposed in correspondence to the loading position of the respective paper feeding cassettes 301 to 305. The residual paper sheet quantity detection sensor 105*a* is disposed in correspondence to the loading position of the MP tray 300. Here, the residual paper sheet quantity detection sensors 105*a* to 105*f* may be a mechanical or optical one.

In addition, in the inside of the MFP main body 101, there are provided conveyance rollers 108*a* to 108*c*. The conveyance rollers 108*a* are disposed on both sides of the carrying passage 110 from the respective MP tray 300 and paper feeding cassettes 301 to 305 to the printer part 141. In addition, the conveyance rollers 108*b* and 108*c* are disposed on both sides of the carrying passage 111 from the printer part 141 to the paper delivery tray 102.

In the respective paper feeding cassettes 301 to 305, there is provided a lifting plate 301*a*, which is pushed up at a place opposed to the feeding roller 106 by a lifting member 112, which is provided in the inside of the MFP main body 101. Then, with the lifting plate 301*a* being pushed up by the lifting member 112, the distal end portion of the paper sheet 200 on the lifting plate 301*a* is pressed against the feeding roller 106. Thereby, the paper sheets 200 in the respective paper feeding cassettes 301 to 305 are fed out one by one by the feeding roller 106. In addition, in the state in which the distal end portion of the paper sheet 200 on the lifting plate 301*a* is pushed up, detection of the residual paper sheet quantity by the residual paper sheet quantity detection sensors 105*b* to 105*f* is performed. The residual paper sheet quantity detection sensor 105*a* detects the residual paper sheet quantity in the state in which the paper sheet 200 is set in the MP tray 300.

The residual paper sheet quantity detection sensors 105*b* to 105*f* may detect the residual paper sheet quantity from such a factor as the inclination of the lifting plate 301*a* that is pushed up by the lifting member 112, or may detect the residual paper sheet quantity from the movable amount of the lifting member 112. In addition, the residual paper sheet quantity detection sensor 105*a* may detect the residual paper sheet quantity from such a factor as the thickness of the paper sheets 200 that are set in the MP tray 300.

Here, as later described in detail, when the residual paper sheet quantity detection sensors 105*a* to 105*f* detect the residual paper sheet quantity, a paper feeding stage selection part 130, which is later-described, alters the levels of priority in paper feeding stage searching operation by a paper feeding stage searching part 129, which is later-described, based on the number of sheets required for printing and the residual paper sheet quantity. In addition, based on the result of selection of a paper feeding stage by the paper feeding stage selection part 130, which is later-described, a system control part 133, which is later-described, performs change-over of paper feeding stages.

The paper sheet 200 that has been fed by the feeding roller 106 is conveyed to the printer part 141 by the conveyance rollers 108*a* along the carrying passage 110. In addition, the paper sheet 200 in the MP tray 300 is also conveyed to the printer part 141 along the carrying passage 110. The paper sheet 200, which has been subjected to printing by the printer part 141, is conveyed to the paper delivery tray 102 by the conveyance rollers 108*b* and 108*c* along the carrying passage 111.

Figure 2:
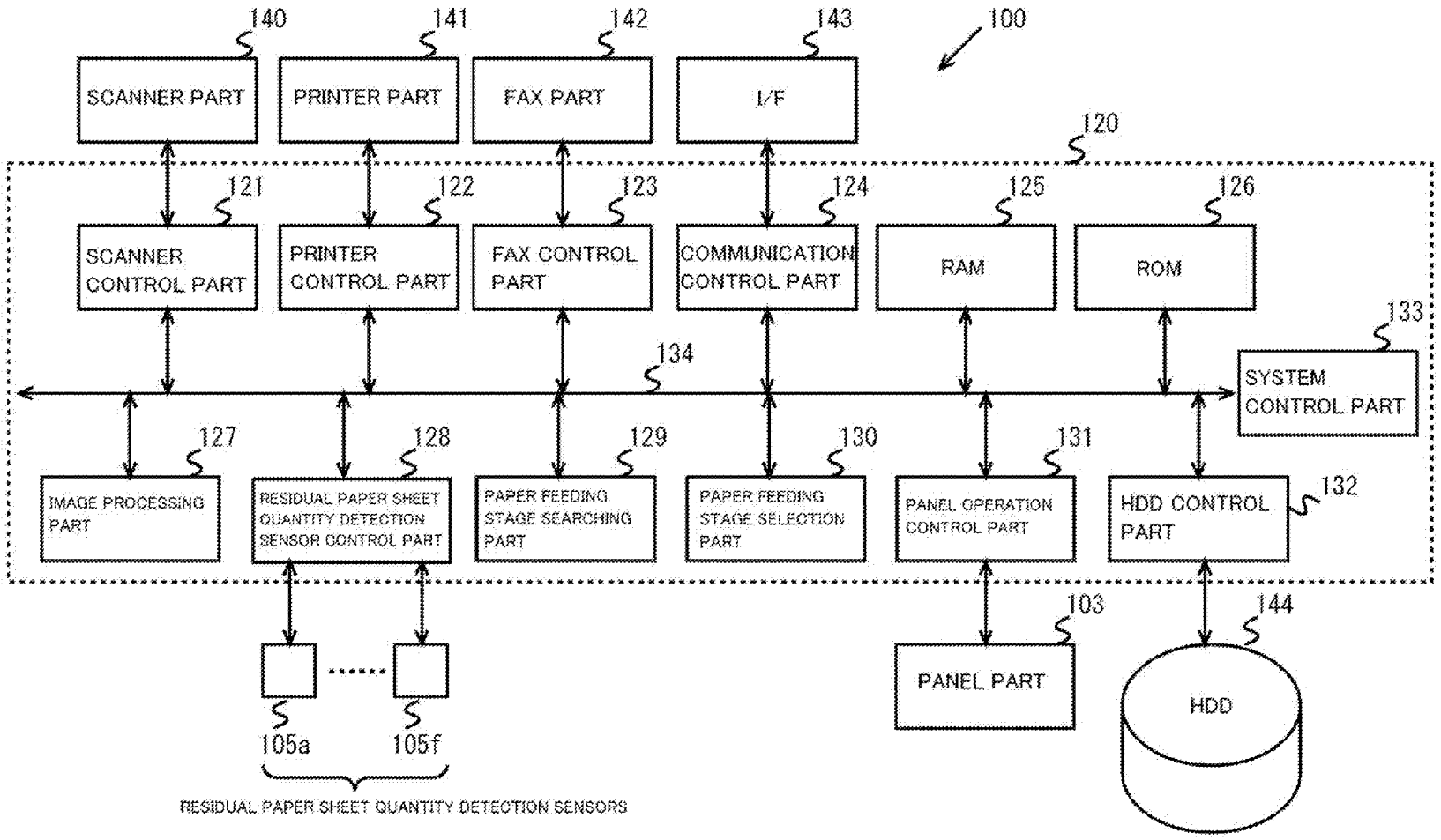
FIG. 2 illustrates a configuration of the MFP in FIG. 1.

Next, with reference to FIG. 2, the configuration of the MFP 100 will be explained. The MFP 100 includes a control part 120, a scanner part 140, a printer part 141, a FAX part 142, an I/F (interface) 143, residual paper sheet quantity detection sensors 105*a* to 105*f*, a panel part 103, and an HDD (hard disk drive) 144.

The scanner part 140 inputs image data of a document read by an image sensor to the control part 120. In other words, the scanner part 140 converts an image signal for the document from the image sensor into digital image data, and sequentially inputs it to the control part 120.

The printer part 141 prints an image on the paper sheet 200 based on the image data outputted from the control part 120. The FAX part 142 transmits the image data outputted from the control part 120 to a facsimile on the opposite party through a telephone line, and receives image data from the facsimile on the opposite party to input it to the control part 120. In other words, the FAX part 142 compresses and modulates the image data outputted from the control part 120 to transmit it to the facsimile on the opposite party, while controlling the connection to the telephone line with an NCU (Network Control Unit). In addition, the FAX part 142 demodulates and expands the image data from the facsimile on the opposite party to input it to the control part 120, while connecting to the telephone line with the NCU.

The I/F 143 performs a communication with a client terminal, for example, through a network, such as an in-house LAN (Local Area Network). The residual paper sheet quantity detection sensors 105*a* to 105*f*, as described above, detect the residual quantity of the paper sheet 200 that is stored in the MP tray 300 and paper feeding cassettes 301 to 305.

The panel part 103 displays operation buttons, and the like, for selecting any one of the printing function, the FAX function, and the scanning function of the MFP 100, and the type of the paper sheet 200 (such as paper quality or the size) in printing, or the like, and further for performing various types of setting operations including specifying any one of the paper feeding cassettes 301 to 305 as the default, and the like. In the HDD 144, application programs, and the like, for providing various functions of the MFP 100 are stored. In addition, in the HDD 144, a user box, and the like, are provided. The default may be registered as an initial setting for the MFP 100, or may be set when the user operates the MFP 100. Here, in the case where, when the user operates the MFP 100, none of the paper feeding stages (the MP tray 300 and the paper feeding cassettes 301 to 305) is selected, a paper feeding stage registered as an initial setting can be made to be the default. On the other hand, in the case where any one of the paper feeding stages is selected, the selected paper feeding stage can be made to be the default.

The control part 120 controls the entire operation of the MFP 100, including a scanner control part 121, a printer control part 122, a FAX (facsimile) control part 123, a communication control part 124, an RAM (Random Access Memory) 125, an ROM (Read Only Memory) 126, an image processing part 127, a residual paper sheet quantity detection sensor control part 128, a paper feeding stage searching part 129, a paper feeding stage selection part 130, a panel operation control part 131, an HDD control part 132, and a system control part 133. In addition, these are connected to a data bus 134.

The scanner control part 121 controls the reading operation of the scanner part 140. The printer control part 122 controls the printing operation of the printer part 141. The FAX control part 123 controls the image data transmission/reception operation by the FAX part 142. The communication control part 124 controls the communication through the I/F 143.

The RAM 125 is a work memory for executing a program. The ROM 126 stores control programs, and the like, to perform operation inspection, and the like, of the respective parts. The image processing part 127 performs image processing for a printing job, for example. In addition, the image processing part 127 performs image processing for image data of a document read by, for example, the scanner part 140. In addition, under the control of the system control part 133, the image processing part 127 generates data indicating a printing request for the MP tray or each of the paper feeding cassettes 301 to 305 from which paper sheet feeding is to be performed, and outputs it to the printer control part 122. Upon a changeover of paper feeding stages being performed under the control of the system control part 133, the image processing part 127 regenerates data indicating a printing request for the MP tray or each of the paper feeding cassettes 301 to 305 from which paper sheet feeding is to be performed by the changeover, and outputs it to the printer control part 122.

The residual paper sheet quantity detection sensor control part 128 controls the operation of detection of the residual quantity of the paper sheet 200 by the residual paper sheet quantity detection sensors 105*a* to 105*f*. In addition, the residual paper sheet quantity detection sensor control part 128 notifies the later-described paper feeding stage selection part 130 of the residual paper sheet quantity that has been detected by the residual paper sheet quantity detection sensors 105*a* to 105*f*. In addition, in the case where any one of the residual paper sheet quantity detection sensors 105*a* to 105*f* has not detected the residual paper sheet quantity, in other words, has detected paper sheet absence, the residual paper sheet quantity detection sensor control part 128 notifies it to the later-described paper feeding stage selection part 130, which notifies the system control part 133 of paper sheet absence.

The residual paper sheet quantity detection sensor control part 128 may notify the later-described paper feeding stage searching part 129 of the residual paper sheet quantity that has been detected by the residual paper sheet quantity detection sensors 105*a* to 105*f*. In addition, in the case where any one of the residual paper sheet quantity detection sensors 105*a* to 105*f* has not detected the residual paper sheet quantity, in other words, has detected paper sheet absence, the residual paper sheet quantity detection sensor control part 128 may notify it to the later-described paper feeding stage searching part 129, which may notify the system control part 133 of paper sheet absence. Specifically, being instructed by the system control part 133, the residual paper sheet quantity detection sensor control part 128 notifies the system control part 133 of the result of detection of the residual paper sheet quantity by any one of the residual paper sheet quantity detection sensors 105*a* to 105*f*. In addition, the residual paper sheet quantity detection sensor control part 128 may notify the system control part 133 of the result of detection when the printing is started and every time paper sheet feeding is performed from any one of the paper feeding stages (the MP tray and the paper feeding cassettes 301 to 305). In addition, the residual paper sheet quantity detection sensor control part 128 may notify the system control part 133 of the result of detection every definite period of time (for example, 10 msec).

The paper feeding stage searching part 129 performs a paper feeding stage searching operation for the MP tray or any one of the paper feeding cassettes 301 to 305 that is capable of paper sheet feeding, when paper sheet feeding is requested for the first time after the printing has been started and every time paper sheet feeding is performed from the MP tray or any one of the paper feeding cassettes 301 to 305. In other words, in the case where, for example, the paper sheet 200 that is stored in the MP tray or the paper feeding cassettes 301 to 305 is of the same type as the type (such as paper quality or size) of the paper sheet 200 that has been designated for printing, the paper feeding stage searching part 129 determines that the MP tray or the paper feeding cassettes 301 to 305 is capable of paper sheet feeding. Contrarily, in the case where the paper sheet 200 that is stored in the MP tray or the paper feeding cassettes 301 to 305 is of a type different from the type (such as paper quality or size) of the paper sheet 200 that has been designated for printing, the paper feeding stage searching part 129 determines that the MP tray or the paper feeding cassettes 301 to 305 is not capable of paper sheet feeding.

Under the control of the system control part 133, the paper feeding stage selection part 130 grasps the residual paper sheet quantities of the MP tray and the paper feeding cassettes 301 to 305 based on the results of detection from the residual paper sheet quantity detection sensor control part 128. In addition, the paper feeding stage selection part 130 selects a paper feeding stage that is capable of paper sheet feeding, based on any one of the later-described selection patterns 1 to 3, based on the residual paper sheet quantities for the MP tray and the paper feeding cassettes 301 to 305 and the number of paper sheets required for printing that is from the system control part 133. In addition, the paper feeding stage selection part 130 notifies the selected paper feeding stage to the system control part 133.

The panel operation control part 131 controls the display operation of the panel part 103. In addition, the panel operation control part 131 accepts selection, by the user through the panel part 103, of any one of the printing function, the FAX function, and the scanning function. In addition, the panel operation control part 131 accepts setting, by the user through the panel part 103, of the type of the paper sheet 200 (such as paper quality or size) that is stored in the MP tray or the paper feeding cassette 301 to 305. In addition, the panel operation control part 131 accepts paper feeding designation, by the user through the panel part 103, of the MP tray or any one of the paper feeding cassettes 301 to 305 from which paper sheet feeding is to be performed. The panel operation control part 131 notifies the system control part 133 of the received paper feeding designation as the above-mentioned default. In addition, the panel operation control part 131 notifies the system control part 133 also of the contents of the above-mentioned selection and setting that have been accepted through the panel part 103.

The HDD control part 132 controls the writing/reading of data into/from the HDD 144, and the like. The system control part 133 mainly controls paper sheet feeding from the MP tray 300 or any one of the paper feeding cassettes 301 to 305 that is specified as the default, changeover of the paper feeding stage to the MP tray 300 or any one of the paper feeding cassettes 301 to 305 based on the result of selection by the paper feeding stage selection part 130, and the like. In addition, the system control part 133 determines the number of paper sheets required for printing from the data for a printing job to be processed by the image processing part 127 at the time of, for example, starting the printing, and notifies the paper feeding stage selection part 130 thereof. In addition, in the case where, at the time of printing, the user has designated the type (such as paper quality or size) of the paper sheet 200 for printing through the panel part 103, the system control part 133 notifies the paper feeding stage selection part 130 of the type (such as paper quality or size) of the paper sheet 200 that has been designated for printing.

In addition, the system control part 133 causes the image processing part 127 to generate data indicating a printing request for the MP tray or each of the paper feeding cassettes 301 to 305 from which paper sheet feeding is to be performed, and further to output it to the printer control part 122. Upon a changeover of paper feeding stages being performed, the system control part 133 instructs the image processing part 127 to regenerate data indicating a printing request for the MP tray or each of the paper feeding cassettes 301 to 305 from which paper sheet feeding is to be performed by the changeover, and to output it to the printer control part 122.

Next, with reference to FIG. 3A and FIG. 3B, the paper feeding stage selection by the paper feeding stage selection part 130 will be explained. In FIG. 3A and FIG. 3B, only the paper feeding cassettes 301 to 305 are shown for convenience of explanation. In addition, it is assumed that the residual paper sheet quantity detection sensors 105*a* to 105*f* for detecting the residual quantity of the paper sheet 200 stored in the paper feeding cassettes 301 to 305 detect the residual paper sheet quantity in a specific ratio to the maximum allowable number of paper sheets to be stored in the paper feeding cassettes 301 to 305. By the way, in the case where the maximum allowable number of paper sheets to be stored in the respective paper feeding cassettes 301 to 305 is 100, and the result of detection by the residual paper sheet quantity detection sensors 105*a* to 105*f* is 10%, it is assumed that the number of paper sheets that are stored in the paper feeding cassettes 301 to 305 is 10 or so.

In addition, FIG. 3A is a figure for explaining a typical paper feeding stage selection that is used for comparison with the paper feeding stage selection by the paper feeding stage selection part 130 in the present embodiment, while FIG. 3B is a figure for explaining the paper feeding stage selection by the paper feeding stage selection part 130 in the present embodiment. In addition, for the respective paper feeding cassettes 301 to 305, whether paper sheet feeding is capable or not capable, and the residual paper sheet quantity are indicated. In addition, the bold frame that is shaded with slant lines indicates the default for paper feeding stage that is specified by the user.

In addition, in FIG. 3A, the word of "paper sheet feeding capable" indicates that the paper feeding cassette stores the paper sheet 200 of the same type as the type (such as paper quality or size) of the paper sheet 200 that has been designated for printing by the user through, the panel part 103. On the other hand, the word of "paper sheet feeding not capable" indicates that the paper feeding cassette does not store the paper sheet 200 of the same type as the type (such as paper quality or size) of the paper sheet 200 that has been designated for printing by the user through, for example, the panel part 103. Whether paper sheet feeding is capable or not capable is determined by the paper feeding stage searching part 129, as described above. In addition, in the case where the paper sheets 200 have been used up, it may be determined that paper sheet feeding is not capable. Therefore, in the case where paper sheet feeding is not capable, paper sheet feeding will not be performed.

In addition, the paper feeding stage selection by the paper feeding stage selection part 130 in the present embodiment involves altering the levels of priority in paper feeding stage searching operation by the paper feeding stage searching part 129. Here, the paper feeding stage searching operation by the paper feeding stage searching part 129 is repetitively executed every time paper sheet feeding is performed. This is intended to allow paper sheet feeding to be immediately performed from another paper feeding stage in the event that the paper sheets 200 have been used up in the paper feeding stage in the course of paper sheet feeding. Thereby, in the event that the paper sheets 200 have been used up in the paper feeding stage, interruption of the printing processing can be avoided to allow continuous printing, whereby the convenience for the user can be maintained. In addition, when performing the following paper feeding stage selection, the paper feeding stage selection part 130 receives a notification of the above-mentioned number of paper sheets that are required for printing, and the like, from the system control part 133.

First, in a typical paper feeding stage selection, when the paper feeding stage searching part 129 performs a paper feeding stage searching operation from the paper feeding stage specified to be the default towards the lower stages, the system control part 133 selects the paper feeding stage that is provided with the highest level of priority in paper feeding stage searching operation. Then, the system control part 133 causes paper sheet feeding to be performed from the selected paper feeding stage, which is provided with the highest level of priority in paper feeding stage searching operation. Here, it is assumed that the paper feeding cassettes 301, and 302 to 305 are capable of paper sheet feeding, while the paper feeding cassette 301 is not capable of paper sheet feeding, as shown in FIG. 3A, for example. In addition, it is assumed that the paper feeding cassettes 301 and 302 have a residual paper sheet quantity of 100%, while the paper feeding cassettes 303 to 305 have a residual paper sheet quantity of 10%. In addition, it is assumed that the default is the paper feeding cassette 302. The residual paper sheet quantity is detected by the above-described residual paper sheet quantity sensors 105*b* to 105*f*.

In this case, in the typical paper feeding stage selection, at the start of printing, a paper feeding stage selection operation from the paper feeding cassette 302 of the default towards the lower paper feeding cassettes. The levels of priority in paper feeding stage searching operation in this case are lowered in the order of the paper feeding cassette 302 (the default) ⇒ the paper feeding cassette 303 ⇒ the paper feeding cassette 304 ⇒ the paper feeding cassette 305 ⇒ the paper feeding cassette 301. Here, since the paper feeding cassette 302 (the default) is not capable of paper sheet feeding, the system control part 133 selects the paper feeding cassette 303, the level of priority in paper feeding stage searching operation on which is next higher, for causing it to make paper sheet feeding. In addition, because the paper feeding cassette 303 has a residual paper sheet quantity of 10%, if the number of paper sheets that are required for printing is 30, the system control part 133 selects the paper feeding cassette 304, the level of priority in paper feeding stage searching operation on which is next higher, for causing it to make paper sheet feeding, and then selects the paper feeding cassette 305, the level of priority in paper feeding stage searching operation on which is next higher to the level of priority in paper feeding stage searching operation on the paper feeding cassette 304, for causing it to make paper sheet feeding.

In this way, if the residual paper sheet quantity for the paper feeding cassette 303, the level of priority in paper feeding stage searching operation on which is higher, is smaller than the number of paper sheets that are required for printing, the system control part 133 will perform changeover of paper feeding stages as many times as required. In this case, as described above, for each paper feeding stage that is to be newly selected, it becomes necessary to perform generation and processing of request data for generating data indicating the printing request. Such generation and processing of request data takes a few seconds or so, thereby the performance of continuous printing being lowered even with a model that is capable of high-speed printing.

Then, in the present embodiment, based on the number of paper sheets that are required for printing and the residual paper sheet quantity for the paper feeding cassettes 301 to 305, the levels of priority in paper feeding stage searching operation by the paper feeding stage searching part 129 are altered to thereby prevent the performance of continuous printing from being lowered.

In other words, it is assumed that all paper feeding cassettes 301 to 305 are capable of paper sheet feeding as shown in FIG. 3B. In addition, it is assumed that the paper feeding cassettes 301 and 302 have a residual paper sheet quantity of 10%, that the paper feeding cassette 303 has a residual paper sheet quantity of 30%, that the paper feeding cassette 304 has a residual paper sheet quantity of 50%, and that the paper feeding cassette 305 has a residual paper sheet quantity of 80%. In addition, it is assumed that the default is the paper feeding cassette 301.

In addition, in the case where the default is the paper feeding cassette 301, the levels of priority in paper feeding stage searching operation by the paper feeding stage searching part 129 are such that the paper feeding stage of the default is the highest, and they are lowered in a sequential order from the paper feeding stage just below the paper feeding stage of the default towards the lowest paper feeding stage. Therefore, in the present embodiment, the paper feeding stage searching operation is performed in the order of the paper feeding cassette 301 (the default) ⇒ the paper feeding cassette 302 ⇒ the paper feeding cassette 303 ⇒ the paper feeding cassette 304 ⇒ the paper feeding cassette 305. Assuming that there is also provided a paper feeding stage above the paper feeding cassette of the default, the levels of priority in paper feeding stage searching operation are lowered in a sequential order from the highest paper feeding stage towards the paper feeding stage just above the paper feeding cassette of the default, following the lowest paper feeding stage. Here, in general, at the time of starting of printing, paper sheet feeding is performed from the paper feeding cassette 301, which is provided with the highest level of priority in paper feeding stage searching operation, however, in the present embodiment, the paper feeding stage selection part 130 alters the levels of priority in paper feeding stage searching operation by one of the following selection patterns 1 to 3.

(Selection Pattern 1)

The paper feeding stage selection part 130 selects one of the paper feeding cassettes 301 to 305 that stores paper sheets 200 the number of which is larger than is required for printing. Here, if the number of paper sheets that are required for printing is, for example, 60, the paper feeding cassette 305, which has a residual paper sheet quantity of 80%, is selected. Then, upon the paper feeding stage selection part 130 notifying the system control part 133 of the selected paper feeding cassette 305, the system control part 133 causes paper sheet feeding to be performed from the paper feeding cassette 305. In this way, by selecting the paper feeding cassette 305, which has a residual paper sheet quantity larger than the number of sheets that are required for printing, the need for changeover of paper feeding stages is eliminated until the printing is completed.

(Selection Pattern 2)

In the case where a plurality (more than one) of paper feeding cassettes of the paper feeding cassettes 301 to 305 store paper sheets 200 the number of which is larger than is required for printing, the paper feeding stage selection part 130 selects a paper feeding cassette that is the closest to the printer part 141 therefrom. Specifically, if the number of paper sheets that are required for printing is, for example, 25, the paper feeding cassette 303, which has a residual paper sheet quantity of 30%, the paper feeding cassette 304, which has a residual paper sheet quantity of 50%, and the paper feeding cassette 305, which has a residual paper sheet quantity of 80%, store paper sheets 200 the number of which is larger than is required for printing.

In this case, the paper feeding cassettes 301 to 305 are disposed, being vertically stacked, as shown in FIG. 1, and thus the paper feeding stage selection part 130 selects the paper feeding cassette 303, which is the closest to the printer part 141. Then, upon the paper feeding stage selection part 130 notifying the system control part 133 of the selected paper feeding cassette 303, the system control part 133 causes paper sheet feeding to be performed from the paper feeding cassette 303. In this way, in the case where a plurality (more than one) of paper feeding cassettes of the paper feeding cassettes 301 to 305 store paper sheets 200 the number of which is larger than is required for printing, the paper feeding stage selection part 130 selects a paper feeding cassette that is the closest to the printer part 141 therefrom, thereby the time for paper sheet conveyance being held to a minimum, and thus the performance of continuous printing can be prevented from being lowered.

(Selection Pattern 3)

In the case where none of the paper feeding cassettes 301 to 305 stores paper sheets 200 the number of which is larger than is required for printing, the paper feeding stage selection part 130 selects a paper feeding cassette that has the largest number of paper sheets therefrom. Here, if the number of paper sheets that are required for printing is, for example, 100, the paper feeding stage selection part 130 selects the paper feeding cassette 305, which has a residual paper sheet quantity of 80%, and thus has the largest residual paper sheet quantity. Then, upon the paper feeding stage selection part 130 notifying the system control part 133 of the selected paper feeding cassette 305, the system control part 133 causes paper sheet feeding to be performed from the paper feeding cassette 305.

In this case, when the paper sheets in the paper feeding cassette 305 have been used up, the paper feeding stage selection part 130 selects the paper feeding cassette 304, which has a next larger residual paper sheet quantity, and notifies the system control part 133 thereof. The paper feeding stage selection part 130 may compare between the number of paper sheets that are required for printing and the residual paper sheet quantity for the respective paper feeding cassettes 301 to 305; from the paper feeding cassettes 301 to 305, select ones the total of the residual paper sheet quantities for which is larger than the number of paper sheets that are required for printing; and previously notify the system control part 133 of that selection.

Specifically, when the number of paper sheets that are required for printing is, for example, 100, the paper feeding stage selection part 130 may select the paper feeding cassette 305, which has a residual paper sheet quantity of 80% and the paper feeding cassette 304, which has a residual paper sheet quantity of 50%, and previously notify the system control part 133 of that selection. In addition, the paper feeding stage selection part 130 may select the paper feeding cassette 305, which has a residual paper sheet quantity of 80% and the paper feeding cassette 303, which has a residual paper sheet quantity of 30%, and previously notify the system control part 133 of that selection.

In this case, the paper feeding stage selection part 130 may determine which is closer to the printer part 141, the paper feeding cassette 303 or the paper feeding cassette 304, and may select the paper feeding cassette 303, which is closer to the printer part 141, in preference to the paper feeding cassette 304, and in addition select the paper feeding cassette 305, which has the largest residual paper sheet quantity. Thereby, when the paper sheets 200 in the paper feeding cassette 305 have been used up, the system control part 133 can immediately cause paper sheet feeding to be performed from the paper feeding cassette 303 or the paper feeding cassette 304, whereby the time required for change-over of paper feeding stages can be held to a minimum.

Figure 4:
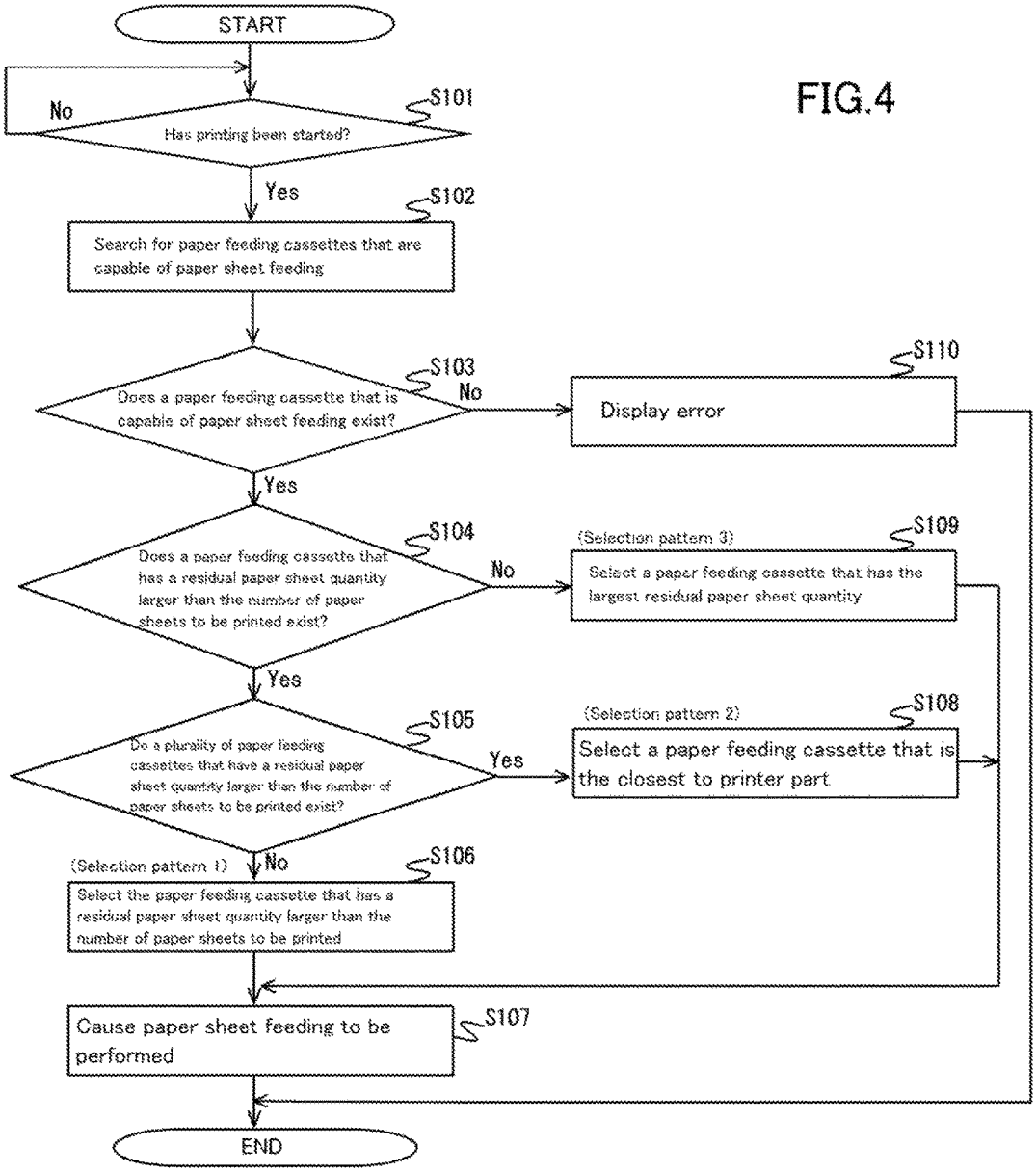
FIG. 4 illustrates the steps of operation of selecting a paper feeding stage by the MFP in FIG. 1.

Next, with reference to FIG. 4, the operation of selection of a paper feeding stage by the MFP 100 will be explained. In the following, it is assumed for convenience of explanation that, with the printing being started, paper sheet feeding is performed from any one of the paper feeding cassettes 301 to 305. In addition, it is assumed that all the paper feeding cassettes 301 to 305 are capable of paper sheet feeding as shown in FIG. 3B. In addition, as shown in FIG. 3B, it is assumed that the paper feeding cassettes 301 and 302 have a residual paper sheet quantity of 10%; the paper feeding cassette 303 has a residual paper sheet quantity of 30%; the paper feeding cassette 304 has a residual paper sheet quantity of 50%; and the paper feeding cassette 305 has a residual paper sheet quantity of 80%. In addition, it is assumed that the default is the paper feeding cassette 301.

(Step S101)

The system control part 133 determines whether or not the printing has been started. In this case, the system control part 133 waits until there is given a notification from the panel operation control part 131 of that the selection of the printing function by the user has been received through the panel part 103 (NO at Step 101). Then, if there has been given a notification from the panel operation control part 131 of that the selection of the printing function by the user has been received through the panel part 103, the system control part 133 determines that the printing has been started (YES at Step S101). Upon start of the printing having been determined, the system control part 133 instructs the paper feeding stage searching part 129 to perform a paper feeding stage searching operation, and instructs the paper feeding stage selection part 130 to select a paper feeding stage.

In this case, the system control part 133 notifies the paper feeding stage searching part 129 of any one of the paper feeding cassettes 301 to 305 that is specified as the default, and the type (such as paper quality or size) of the paper sheet 200 that has been designated for printing by the user through, for example, the panel part 103. In the case where the system control part 133 has received a paper feeding designation of any one of the paper feeding cassettes 301 to 305 as the paper feeding stage by the user through the panel part 103, the system control part 133 determines the default based on the paper feeding designation. In addition, the system control part 133 notifies the paper feeding stage selection part 130 of the number of paper sheets that are required for printing.

(Step S102)

The paper feeding stage searching part 129 searches the paper feeding cassettes 301 to 305 for ones that are capable of paper sheet feeding. In this case, in order to search the paper feeding cassettes 301 to 305 for ones that are capable of paper sheet feeding, the paper feeding stage searching part 129 first makes a paper feeding stage searching operation from the paper feeding stage specified as the default towards the lower stages. Specifically, in the case of FIG. 3B, all the paper feeding cassettes 301 to 305 store the paper sheet 200. The levels of priority in paper feeding stage searching operation in this case are lowered in the order of the paper feeding cassette 301 ⇒ the paper feeding cassette 302 ⇒ the paper feeding cassette 303 ⇒ the paper feeding cassette 304 ⇒ the paper feeding cassette 305. In this case, if there exists a paper feeding cassette that does not store the paper sheet 200 of the same type as the type (such as paper quality or size) of the paper sheet 200 that the user has designated for printing through the panel part 103, the paper feeding stage searching part 129 determines that the paper feeding cassette is not capable of paper sheet feeding.

(Step S103)

Based on the result of the paper feeding stage searching operation by the paper feeding stage searching part 129, the paper feeding stage selection part 130 determines whether or not there exists a paper feeding cassette that is capable of paper sheet feeding. Here, all the paper feeding cassettes 301 to 305 store the paper sheet 200, and therefore, the paper feeding stage selection part 130 determines that there exists a paper feeding cassette that is capable of paper sheet feeding, (YES at Step S103), and proceeds to Step S104.

Contrarily, if it is determined that there exists no paper feeding cassette that is capable of paper sheet feeding, (NO at Step S103), the paper feeding stage selection part 130 notifies the system control part 133 thereof.

(Step S104)

The paper feeding stage selection part 130 determines whether or not there exists a paper feeding cassette that has a residual paper sheet quantity larger than the number of paper sheets to be printed. If it is determined that there exists no paper feeding cassette that has a residual paper sheet quantity larger than the number of paper sheets to be printed, (NO at Step S104), the paper feeding stage selection part 130 proceeds to Step S109. Contrarily, if it is determined that there exists a paper feeding cassette that has a residual paper sheet quantity larger than the number of paper sheets to be printed, (YES at Step S104), the paper feeding stage selection part 130 proceeds to Step S105.

Specifically, if the number of paper sheets that are required for printing is, for example, 100, since even the paper feeding cassette 305 that has the largest residual paper sheet quantity has a residual paper sheet quantity of 80%, as explained with reference to FIG. 3B, the paper feeding stage selection part 130 determines that there exists no paper feeding cassette that has a residual paper sheet quantity larger than the number of paper sheets to be printed.

Contrarily, if the number of paper sheets that are required for printing is, for example, 25, since the paper feeding cassettes 303 to 305 have a residual paper sheet quantity of 30% or over, the paper feeding stage selection part 130 determines that there exists a paper feeding cassette that has a residual paper sheet quantity larger than the number of paper sheets to be printed.

(Step S105)

The paper feeding stage selection part 130 determines whether or not there exist a plurality of (more than one) paper feeding cassettes that have a residual paper sheet quantity larger than the number of paper sheets to be printed. If it is determined that there exist no plurality of (more than one) paper feeding cassettes that have a residual paper sheet quantity larger than the number of paper sheets to be printed, (NO at Step S105), the paper feeding stage selection part 130 proceeds to Step S106. Contrarily, it is determined that there exist a plurality of (more than one) paper feeding cassettes that have a residual paper sheet quantity larger than the number of paper sheets to be printed, (YES at Step S105), the paper feeding stage selection part 130 proceeds to Step S108.

(Step S106: Selection Pattern 1)

The paper feeding stage selection part 130 selects the paper feeding cassette 301 to 305 that has a residual paper sheet quantity larger than the number of paper sheets to be printed, and notifies the system control part 133 thereof.

In this case, if the number of paper sheets that are required for printing is, for example, 60, since the residual paper sheet quantity (80%) for the paper feeding cassette 305 is larger than the number of paper sheets that are required for printing (60), as explained with reference to FIG. 3B, the paper feeding stage selection part 130 selects the paper feeding cassette 305.

(Step S107)

Based on the result of selection of the paper feeding stage by the paper feeding stage selection part 130, the system control part 133 causes paper sheet feeding from the paper feeding cassette 305 to be performed as explained with reference to FIG. 3B. In addition, the system control part 133 instructs the printer control part 122 to perform printing by the printer part 141. In this case, the system control part 133 causes the image processing part 127 to perform image processing for a printing job, for example. In addition, the system control part 133 causes the image processing part 127 to output the processed image data to the printer control part 122.

(Step S108: Selection Pattern 2)

If, at Step S105, it is determined that there exist a plurality of (more than one) paper feeding cassettes that have a residual paper sheet quantity larger than the number of paper sheets to be printed, the system control part 133 selects a paper feeding cassette that is the closest to the printer part 141 therefrom, and notifies the system control part 133 thereof. Based on the result of selection of a paper feeding stage by the paper feeding stage selection part 130, the system control part 133 causes paper sheet feeding to be performed from any one of the paper feeding cassettes 301 to 305 at Step S107 in the same manner as described above.

In this case, as explained with reference to FIG. 3B, if the number of paper sheets that are required for printing is 25, for example, the paper feeding cassettes 303 to 305 have a residual paper sheet quantity of 30% or over.

In addition, the paper feeding cassettes 301 to 305 are disposed, being vertically stacked, as shown in FIG. 1. Then, the paper feeding stage selection part 130 selects the paper feeding cassette 303, which is the closest to the printer part 141.

In this way, in the case where a plurality (more than one) of paper feeding cassettes 303 to 305 store paper sheets 200 the number of which is larger than the number of paper sheets 200 required for printing (25, for example), the paper feeding stage selection part 130 selects a paper feeding cassette 303 that is the closest to the printer part 141 therefrom, thereby the time required for conveyance of a paper sheet 200 from the paper sheet cassette 303 to the printer part 141 being held to a minimum, and thus the performance of continuous printing can be prevented from being lowered.

(Step S109: Selection Pattern 3)

If, at Step S104, it is determined that there exists no paper feeding cassette that has a residual paper sheet quantity larger than the number of paper sheets to be printed, the paper feeding stage selection part 130 selects a paper feeding cassette that has the largest residual paper sheet quantity, and notifies the system control part 133 of that selection.

In this case, as explained with reference to FIG. 3B, the paper feeding stage selection part 130 selects the paper feeding cassette 305, which has the largest residual paper sheet quantity (80%).

(Step S110)

If, at Step S103, it is determined that there exists no paper feeding cassette that is capable of paper sheet feeding, upon the system control part 133 having received a notification from the paper feeding stage selection part 130 thereof, the system control part 133 causes the panel part 103 to display an error through the panel operation control part 131. The contents of the error in this case indicate such matters as that there exists no paper feeding cassette that is capable of paper sheet feeding.

As described above, in the present embodiment, in the case where the paper feeding cassettes 301 to 305 are capable of paper sheet feeding, the paper feeding stage selection part 130 alters the levels of priority in paper feeding stage searching operation by the paper feeding stage searching part 129 based on the result of detection by the residual paper sheet quantity detection sensors 105*a* to 105*f* and the number of paper sheets that are required for printing, selecting a paper feeding stage. Thereby, the time required for changeover of paper feeding stages by the system control part 133 can be held to a minimum, whereby the performance of continuous printing can be prevented from being lowered.

Specifically, in the case where the paper feeding cassettes 301 to 305 are capable of paper sheet feeding, the paper feeding stage selection part 130 selects a paper feeding cassette 301 to 305 that stores paper sheets 200 the number of which is larger than is required for printing. In this way, by selecting a paper feeding cassette 301 to 305 that stores paper sheets 200 the number of which is larger than is required for printing, the need for changeover of paper feeding cassettes is eliminated until the printing is completed.

In addition, in the case where there exist a plurality of (more than one) paper feeding cassettes 301 to 305 that have a residual paper sheet quantity than is larger than is required for printing, the paper stage selection part 130 selects the paper sheet cassette 301 to 305 that is the closest to the printer part 141 therefrom. In this way, by the paper feeding stage selection part 130 selecting a paper feeding cassette 301 to 305 that is the closest to the printer part 141, the time for paper sheet conveyance being held to a minimum, and thus the performance of continuous printing can be prevented from being lowered.

In addition, in the case where there exists no paper feeding cassette 301 to 305 that stores paper sheets 200 the number of which is larger than is required for printing, the paper feeding stage selection part 130 selects a paper feeding cassette that has the largest residual paper sheet quantity. Thereby, when the paper sheets 200 in the selected paper feeding cassette 301 to 305 have been used up, the system control part 133 can immediately cause paper sheet feeding to be made from the next paper feeding cassette 301 to 305 that has been selected by the paper feeding stage selection part 130, whereby the time required for changeover of paper feeding stages can be held to a minimum.

With a typical image forming apparatus, when changeover of trays is performed in, for example, the course of continuous printing, a tray the distance from which to the intermediate transfer belt is shorter is selected, whereby failures such as deterioration of an image or degradation of productivity occurring when an image path is longer than a paper sheet feeding path can be avoided.

However, with such an image forming apparatus, the levels of priority in changeover of trays are provided in the order of shorter distances to the intermediate transfer belt. Therefore, even if trays can be changed over in the order of shorter distances to the intermediate transfer belt, in the case where the respective trays store paper sheets the number of which is smaller than is required for printing, it may be required to frequently perform changeover of trays. If trays are to be frequently changed over in such a way, a process for changing-over of trays is required every time changeover of trays, thereby the performance of continuous printing being lowered, which has been a problem.

By the way, in changing-over of trays, generation and processing of data that indicates the printing request must be performed for each tray that is to be newly selected. Such generation and processing takes a few seconds or so, thereby the performance of continuous printing being lowered even with a model that is capable of high-speed printing.

According to an image forming apparatus of the present disclosure, in the case where there exist paper feeding stages that are capable of paper sheet feeding, the paper feeding stage selection part alters the levels of priority in paper feeding stage searching operation by the paper feeding stage searching part based on the residual paper sheet quantities for the paper feeding stages and the number of paper sheets that are required for printing, selecting a paper feeding stage, whereby the time required for changeover of paper feeding stages by the system control part can be held to a minimum, and thus the performance of continuous printing can be prevented from being lowered.

In the above-described embodiment, the paper feeding cassettes 301 to 305 have been made the objects of paper feeding stage searching and paper feeding stage selection, however, in addition to the paper feeding cassettes 301 to 305, the MP tray 300 may be made an object of paper feeding stage searching and paper feeding stage selection.

What is claimed is:

1. An image forming apparatus, comprising:

a plurality of paper feeding stages that are in the inside of an apparatus main body, a residual paper sheet quantity detection sensor configured to detect a residual quantity of paper sheets that is stored in each of the paper feeding stages of the plurality of paper feeding stages, a printer part configured to perform printing on the paper sheets, a paper feeding stage searching part configured to perform, during printing, a paper feeding stage searching operation every time paper sheet feeding is made from the paper feeding stage, a paper feeding stage selection part configured to determine whether or not the paper feeding stage is capable of paper sheet feeding, based on the result of searching for a paper feeding stage by the paper feeding stage searching part, and select one or more paper feeding stages of the plurality, and a system control part configured to, based on the result of selection by the paper feeding stage selection part, perform changeover of paper feeding from the selected paper feeding stage to the printer part, wherein the paper feeding stage selection part is configured to, in the case where there exists no paper feeding stage that is capable of paper sheet feeding, notify the system control part that there exists no paper feeding stage that is capable of paper sheet feeding, wherein the paper feeding stage selection part is configured to receive a notification of a number of paper sheets required for printing a printing job and compare the number of paper sheets required for printing to the residual quantity of paper sheets stored in each of the paper feeding stages, wherein the paper feeding stage selection part is configured to determine, based on the comparison, whether there exists a paper feeding stage that stores paper sheets the number of which is larger than is required for the printing job, wherein the paper feeding stage selection part is configured to, in the case where there exists the paper feeding stage that is capable of paper sheet feeding and where it was determined that there exists no paper feeding stage that stores paper sheets the number of which is larger than is required for printing, select a first paper feeding stage, of the plurality of paper feeding stages that has the largest residual paper sheet quantity and determine, based on the residual quantity of paper sheets that is stored in each of the paper feeding stages, whether a second paper feeding stage, of the plurality of paper feeding stages, exists that stores a sufficient number of sheets such that the sum total of the number of sheets of the paper stored in the first paper feeding stage and the second paper feeding stage is larger than the number of paper sheets that are required for printing, and select the second paper feeding stage in the case where it is determined that the second paper feeding stage stores the sufficient number of sheets, and wherein the paper feeding stage selection part is configured to select, as the second paper feeding stage, the paper feeding stage which is closer to the printer part preferentially rather than the other paper feeding stages when there are plural paper feeding stages which can be used as the second paper feeding stage.

2. The image forming apparatus according to claim 1, wherein the paper feeding stage selection part is configured to, in the case where there exists the paper feeding stage that is capable of paper sheet feeding, select, in the case where there exists only one paper feeding stage that stores paper sheets the number of which is larger than is required for printing, the paper feeding stage that stores paper sheets the number of which is larger than is required for printing.

3. The image forming apparatus according to claim 1, wherein the paper feeding stage selection part is configured to, in the case where there exists the paper feeding stage that is capable of paper sheet feeding, select, in the case where there exists a plurality of paper feeding stages that each store paper sheets the number of which is larger than is required for printing, the paper feeding stage that is the closest to the printer part from among the plurality of paper feeding stages that each store paper sheets the number of which is larger than is required for printing.

4. The image forming apparatus according to claim 1, wherein, the paper sheet searching part is configured to:

determine that a paper feeding stage of the plurality, which stores a paper sheet that is of the same type as a type of the paper sheet that has been designated for printing, is capable of paper sheet feeding and determine that a paper feeding stage of the plurality, which does not store the paper sheet that is of the same type as the type of the paper sheet that has been designated for printing, is incapable of paper sheet feeding.

* * * * *